US009427987B2

(12) United States Patent
Nakata

(10) Patent No.: US 9,427,987 B2
(45) Date of Patent: Aug. 30, 2016

(54) RECORDING APPARATUS

(71) Applicant: SEIKO EPSON CORPORATION, Tokyo (JP)

(72) Inventor: Masanori Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/625,313

(22) Filed: Feb. 18, 2015

(65) Prior Publication Data

US 2015/0158316 A1 Jun. 11, 2015

Related U.S. Application Data

(63) Continuation of application No. 14/225,802, filed on Mar. 26, 2014.

(30) Foreign Application Priority Data

Mar. 29, 2013 (JP) ..... 2013-072176

(51) Int. Cl.

| | |
|---|---|
| ***B41J 11/00*** | (2006.01) |
| ***B41J 13/02*** | (2006.01) |
| ***B41J 3/60*** | (2006.01) |
| ***B41J 13/10*** | (2006.01) |

(52) U.S. Cl.

CPC *B41J 13/02* (2013.01); *B41J 3/60* (2013.01); *B41J 13/103* (2013.01); *B41J 11/007* (2013.01)

(58) Field of Classification Search

CPC .. B41J 11/007; B41J 13/009; B41J 13/0045; B41J 3/60

USPC ..... 347/104

See application file for complete search history.

(56) References Cited

U.S. PATENT DOCUMENTS

| | | | | |
|---|---|---|---|---|
| 2005/0074266 | A1* | 4/2005 | Hiramoto et al. | 399/391 |
| 2006/0268089 | A1* | 11/2006 | Takeuchi | 347/104 |
| 2011/0049791 | A1 | 3/2011 | Osakabe | |
| 2012/0098188 | A1* | 4/2012 | Ito | 271/207 |
| 2013/0300054 | A1* | 11/2013 | Ishii | 271/225 |

FOREIGN PATENT DOCUMENTS

| | | |
|---|---|---|
| JP | 2005-219860 | 8/2005 |
| JP | 2006-160507 | 6/2006 |
| JP | 2006-327793 | 12/2006 |
| JP | 2011-046497 | 3/2011 |

* cited by examiner

*Primary Examiner* — Julian Huffman
*Assistant Examiner* — Sharon A Polk
(74) *Attorney, Agent, or Firm* — Workman Nydegger

(57) ABSTRACT

A recording apparatus includes a recording head which performs recording on a medium. The recording apparatus includes a first roller that reverses a medium which is transported from the recording head side and a medium reception unit that is provided on the downstream side of the recording head on the medium transport path on which the medium is transported. The medium reception unit also functions as a first medium support unit that supports a medium that is inserted from a discharging direction side of the medium.

8 Claims, 6 Drawing Sheets

RECORDING APPARATUS

CROSS-REFERENCE TO RELATED APPLICATIONS

The present application is a Continuation of U.S. patent application Ser. No. 14/225,802 filed on Mar. 26, 2014, which claims priority to Japanese Patent Application No. 2013-072176, filed on Mar. 29, 2013, which applications are hereby incorporated by reference in their entirety.

BACKGROUND

1. Technical Field

The present invention relates to a recording apparatus which is represented by a fax machine, a printer, or the like.

2. Related Art

In recording apparatuses which are represented by a fax machine, a printer, or the like, there is an apparatus which can execute recording on both surfaces of a printing sheet as an example of a medium. Such a recording apparatus has a reversing path on which a recording sheet is reversed, and the recording sheet on which recording is performed is reversed on the reversing path, and is transported to a region facing a recording head again by having the rear surface as the front surface.

Further, there is an apparatus which includes a manual feeding path for feeding and sending a recording sheet manually, in addition to the above described reversing path. A configuration which includes such a reversing path and a manual feeding path is disclosed in JP-A-2006-160507, and JP-A-2005-219860.

An image forming apparatus which is described in JP-A-2006-160507 includes a manual feeding tray on the rear surface side of the apparatus, and is configured so as to feed a sheet manually from the manual feeding tray which extends from the rear surface side of the apparatus. For this reason, there is a problem in that a space is necessary on the rear surface side of the apparatus, it is not easy to handle, and a dimension in the depth direction of the entire apparatus becomes large.

An image forming apparatus which is described in JP-A-2005-219860 includes an opening portion for manual feeding on the rear surface side of a main body of the apparatus. Accordingly, similarly to the image forming apparatus which is described in JP-A-2006-160507, a space for manual feeding is necessary on the rear surface side of the apparatus, and it is not easy to handle. In addition, similarly to the image forming apparatus which is described in JP-A-2006-160507, since a recording unit, transport paths for printing on both faces, and a paper support are arranged in the vertical direction of the apparatus in an overlapping manner, as a matter of fact, dimensions in the vertical direction of the apparatus become large.

SUMMARY

An advantage of some aspects of the invention is to provide a recording apparatus in which paths for printing on both faces and a manual feeding path are included, manual feeding is easily performed, and an installation space is made small.

According to an aspect of the invention, there is provided a recording apparatus which includes a recording head which performs recording on a medium; a first roller which reverses a medium which is transported from the recording head side; a second roller of which a peripheral surface faces both a medium transport path portion before reversing due to the first roller and a medium transport path portion after reversing, and applies a transport force to the medium; and a medium reception unit which receives a medium which is discharged, in which the medium reception unit also functions as a first medium support unit which supports a medium which is inserted from a medium discharging direction side of the medium.

According to the aspect, since the medium reception unit which receives a discharged medium functions as the first medium support unit which supports the medium which is inserted from the discharging direction side of the medium, it is possible to reduce a cost of the apparatus. In addition, since feeding of the medium through the medium reception unit (first medium support unit) is performed from the discharging direction side of the medium, an operability is good, and a large installation space is not necessary on the side opposite to the discharging direction side of the medium (usually, rear surface side of apparatus), and accordingly, it is possible to reduce the installation space of the apparatus.

In addition, since a reversing path for reversing the medium includes the first roller which reverses the medium, and the second roller of which the peripheral surface faces both the medium transport path before reversing and the medium transport path after reversing due to the first roller, and which applies the transport force to the medium, it is possible to secure the length of the reversing path for reversing the medium using the second roller while preventing a diameter of the first roller from increasing.

In addition, since the second roller faces both the medium transport path before reversing due to the first roller and the medium transport path after reversing, and applies the transport force to the medium, it is possible to reduce the number of rollers which is arranged when one roller (the second roller) can contribute to both the medium transport path before reversing and the medium transport path after reversing, and to suppress a cost increase.

In the recording apparatus, a transport path of a medium which is inserted through the medium reception unit may join the medium transport path before reversing due to the first roller, or the medium transport path after reversing.

According to the aspect, since the transport path of the medium which is inserted through the medium reception unit joins the medium transport path before reversing, or the medium transport path after reversing due to the first roller, it is possible to suppress the cost increase in the apparatus by sharing the transport path.

In the recording apparatus, the transport path of the medium which is inserted through the medium reception unit may be joined at a position of the second roller in the medium transport path before reversing due to the first roller.

According to the aspect, since the transport path of the medium which is inserted through the medium reception unit is joined at the position of the second roller in the medium transport path before reversing due to the first roller, it is possible to apply the transport force to the medium at many more positions, and to transport the medium further reliably.

The recording apparatus may further include a second medium support unit which supports the medium which is inserted into the apparatus, in which a transport path of the medium which is inserted through the second medium support unit joins the transport path on which the medium which is inserted through the medium reception unit at a position of the first roller or the second roller is transported.

According to the aspect, the recording apparatus further includes a second medium support unit which supports a medium which is inserted into the apparatus, and since a transport path of the medium which is inserted through the second medium support unit joins the transport path on which the medium which is inserted through the medium reception unit is transported at a position of the first roller or the second roller, it is possible to suppress the cost increase of the apparatus by sharing a transport path in a configuration which includes a plurality of medium transport paths.

The recording apparatus may further include a medium accommodating unit which is provided at a position lower than the recording head in a vertical direction of the apparatus, can handle a medium from the discharging direction side of the medium, and accommodates the medium, in which the medium which is sent out from the medium accommodating unit passes through at least a part of a reversing transport path which is formed by the first roller, and reaches a position facing the recording head.

According to the aspect, it is possible to make the operability good since the medium accommodating unit can handle the medium from the discharging direction side of the medium, and feeding of the medium through the medium reception unit is also performed from the discharging direction side of the medium, and it is possible to make the installation space of the apparatus small, since it is not necessary to provide a large installation space on the side opposite to the discharging direction side of the medium (usually, rear surface side of apparatus).

In the recording apparatus, at least a part of a region occupied by the reversing transport path may be located at an upper part of the medium accommodating unit.

According to the aspect, since at least a part of the region occupied by the reversing transport path is located at the upper part of the medium accommodating unit, it is possible to further reduce a dimension of the apparatus in a horizontal direction, and to provide a further minimized apparatus.

In the recording apparatus, the transport path on which the medium which is inserted through the medium reception unit is transported may join the transport path on which the medium which is sent out from the medium accommodating unit is transported, and on the transport path on which the medium which is inserted through the medium reception unit is transported, a pair of transport rollers which nips and transports a medium is provided on an upstream side in the medium transport direction of the position at which the transport path on which the medium which is sent out from the medium accommodating unit is transported is joined.

According to the aspect, since the pair of transport rollers which nips and transports the medium is provided on the upstream side in the medium transport direction of the position at which the transport path on which the medium which is sent out from the medium accommodating unit is transported is joined in the transport path on which the medium which is inserted through the medium reception unit is transported, it is not necessary to insert the medium to a deep portion of the apparatus, and it is possible to easily insert the medium when feeding the medium through the medium support unit.

In the recording apparatus, the medium accommodating unit may be detached from a main body of the recording apparatus, a path forming member which forms the transport path of the medium which is inserted through the medium reception unit may be provided along with the medium reception unit at an upper part of a mounting region of the medium accommodating unit in the main body of the apparatus, and the path forming member may be provided so as to switch between a first state in which the transport path of the medium which is inserted through the medium reception unit is formed along with the medium support unit and a second state in which the transport path of the medium which is inserted through the medium reception unit is exposed to the discharging direction side of the medium by descending of the path forming member to the mounting region from the upper part of the mounting region of the medium accommodating unit.

According to the aspect, since the path forming member which forms the transport path of the medium which is inserted through the medium reception unit along with the medium reception unit can expose the transport path to the discharging direction side of the medium by coming down to the mounting region from the upper part of the mounting region of the medium accommodating unit, it is possible to remove a jammed medium from the discharging direction side of the medium, that is, it is possible to easily remove the jammed medium when a medium is jammed on the transport path of the medium which is inserted through the medium reception unit.

In the recording apparatus, one roller of the pair of transport rollers may be provided in the path forming member, and the one roller of the pair of transport rollers may be separated from the other roller when the path forming member is switched from the first state to the second state.

According to the aspect, since the one roller of the pair of transport rollers is provided in the path forming member, and the one roller of the pair of transport rollers is separated from the other roller when the path forming member switches from the first state to the second state, it is possible to release a nipped state of a medium due to the pair of transport rollers, and to further easily remove a jammed medium.

In the recording apparatus, the path forming member may include a unit to be regulated which can be engaged with a regulation unit which is formed on a base configuring the mounting region of the medium accommodating unit, and when the unit to be regulated engages with the regulation unit, a displacement of the path forming member from the medium discharging direction side to the opposite side thereof may be regulated when the path forming member is in the second state.

When the medium accommodating unit is inserted into the mounting region in a state in which the path forming member comes down to the mounting region, there is a concern that the path forming member, or a mounting structure unit of the path forming member may be damaged. However, according to the aspect, since the unit to be regulated is provided in the path forming member, the unit to be regulated engages with the regulation unit which is formed on the base configuring the mounting region of the medium accommodating unit in the second state, and since the displacement of the path forming member from the medium discharging direction side to the opposite side thereof is regulated, it is possible to avoid the above described damage.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
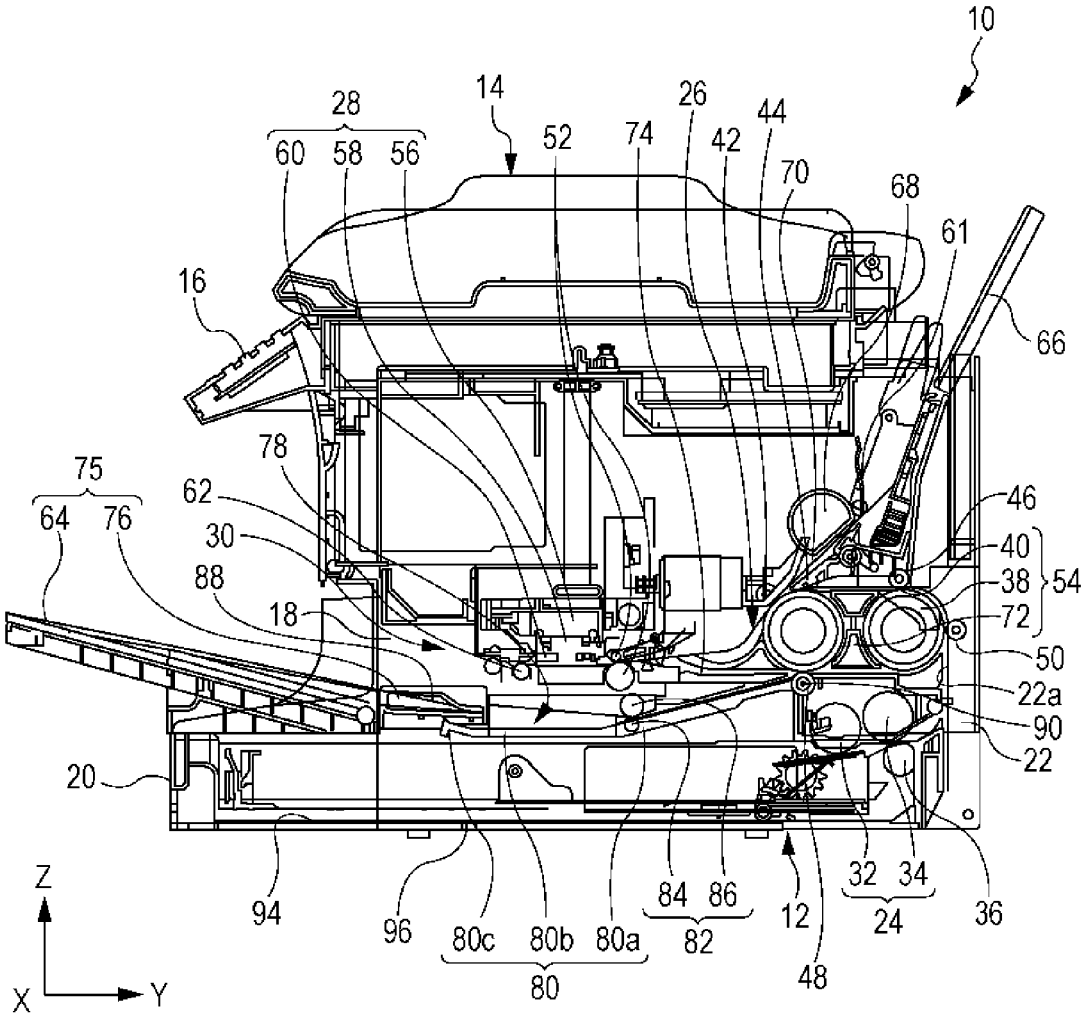
FIG. 1 is a sectional side view which illustrates a medium transport path of a printer according to an embodiment of the invention.

Hereinafter, embodiments of the invention will be described based on drawings. In addition, the same configuration in each example will be given the same reference numerals, and descriptions of the configuration will be made only in the first embodiment, and will be omitted in embodiments thereafter.

Figure 2:
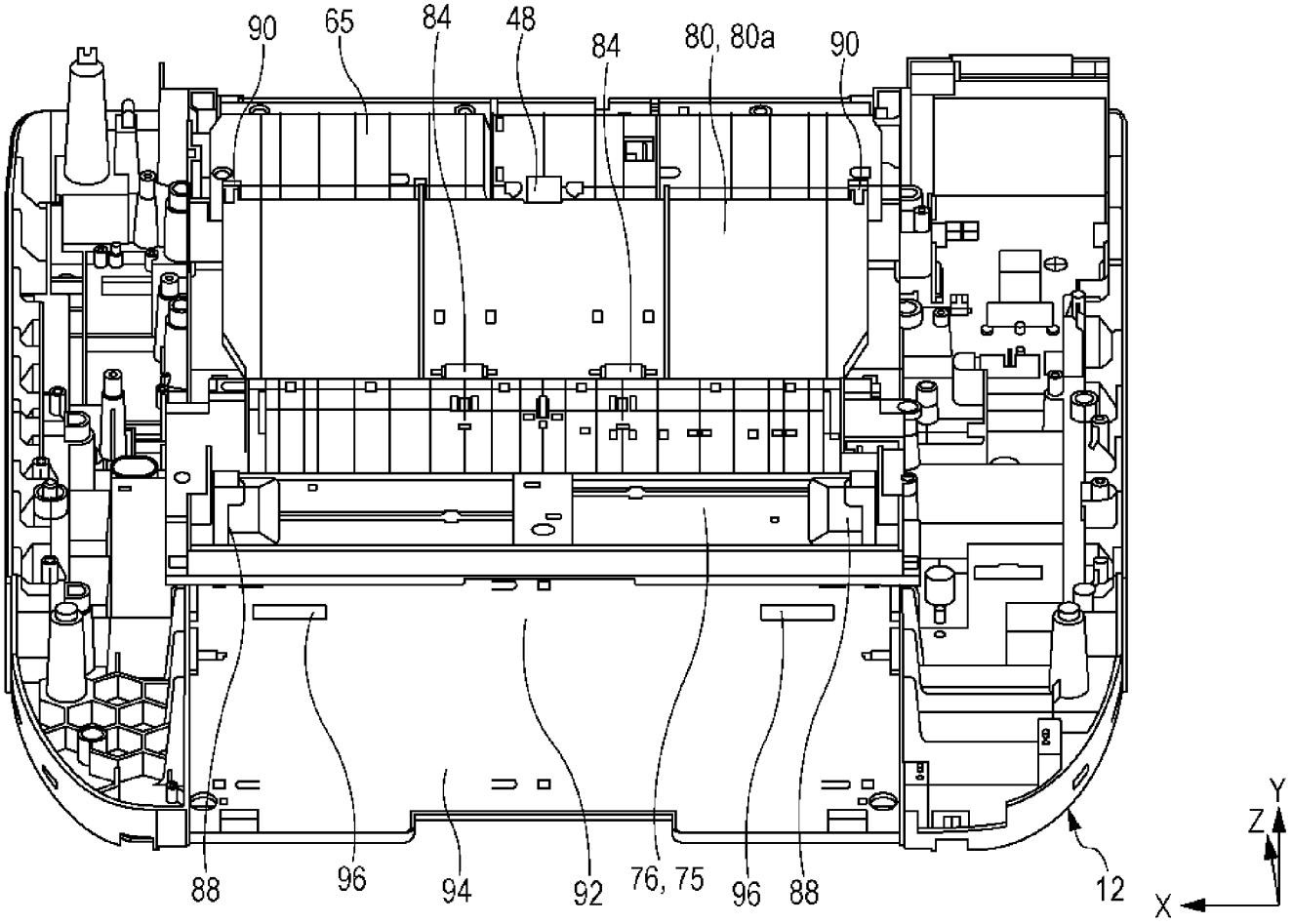
FIG. 2 is a plan view which illustrates a first medium support unit and a second medium transport path of the printer according to the embodiment of the invention.
Figure 3:
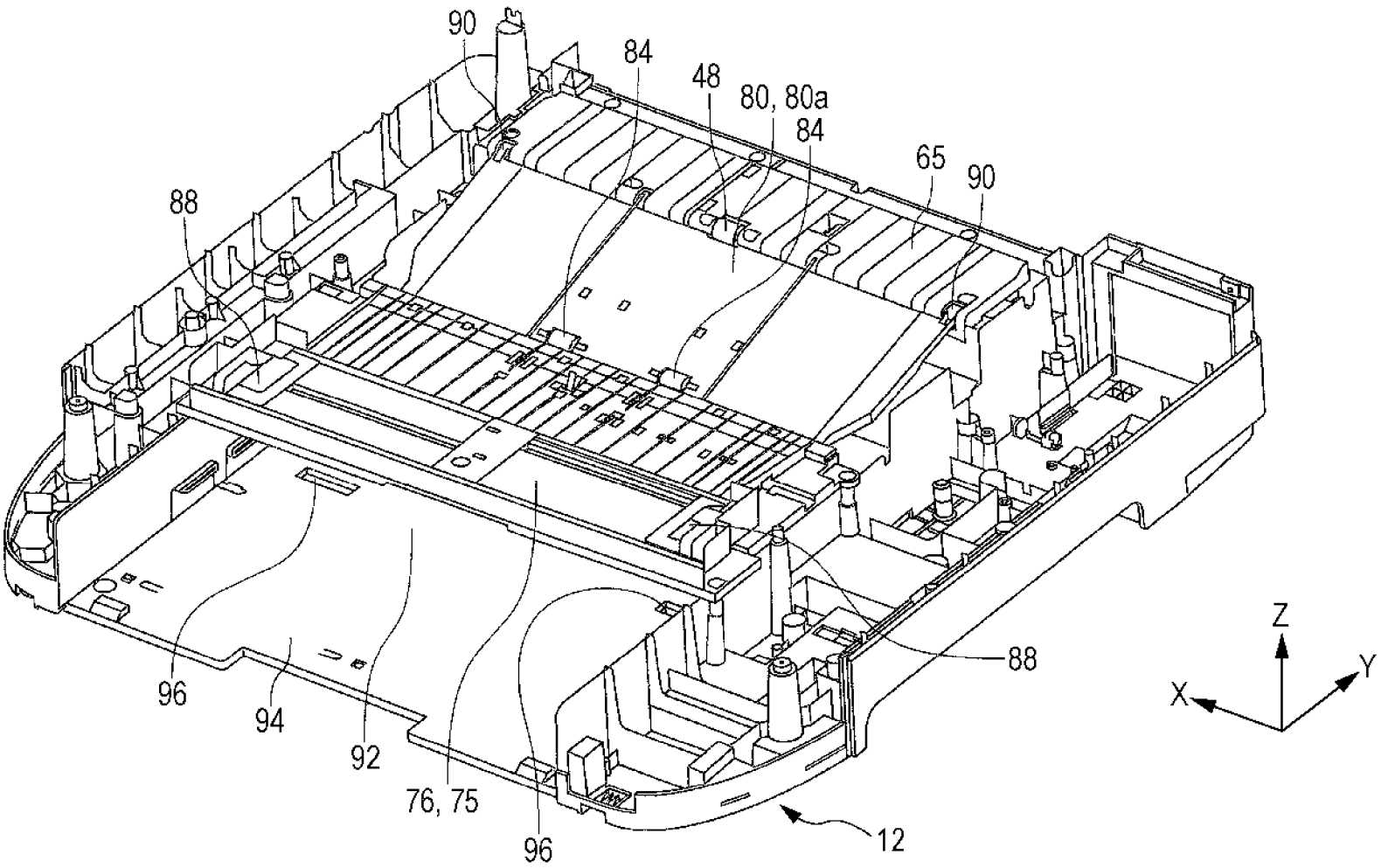
FIG. 3 is a perspective view which illustrates the first medium support unit and the second medium transport path of the printer according to the embodiment of the invention.

FIG. 1 is a sectional side view which illustrates a medium transport path of a printer according to an embodiment of the invention, FIG. 2 is a plan view which illustrates a first medium support unit and a second medium transport path of the printer according to the embodiment of the invention, and FIG. 3 is a perspective view which illustrates the first medium support unit and the second medium transport path of the printer according to the embodiment the invention.

Figure 4:
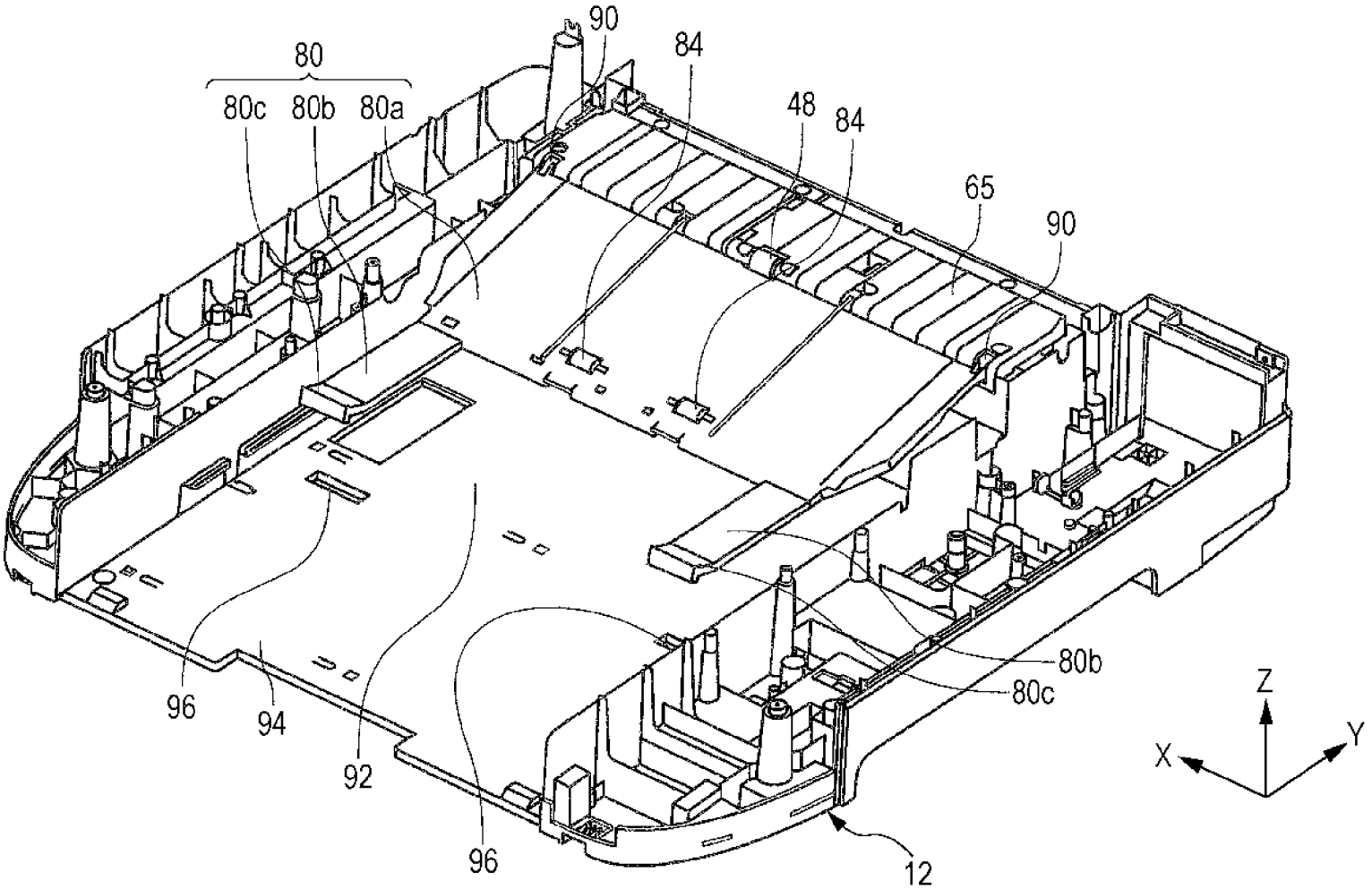
FIG. 4 is a perspective view which illustrates a first state of a path forming member of the printer according to the embodiment of the invention.
Figure 5:
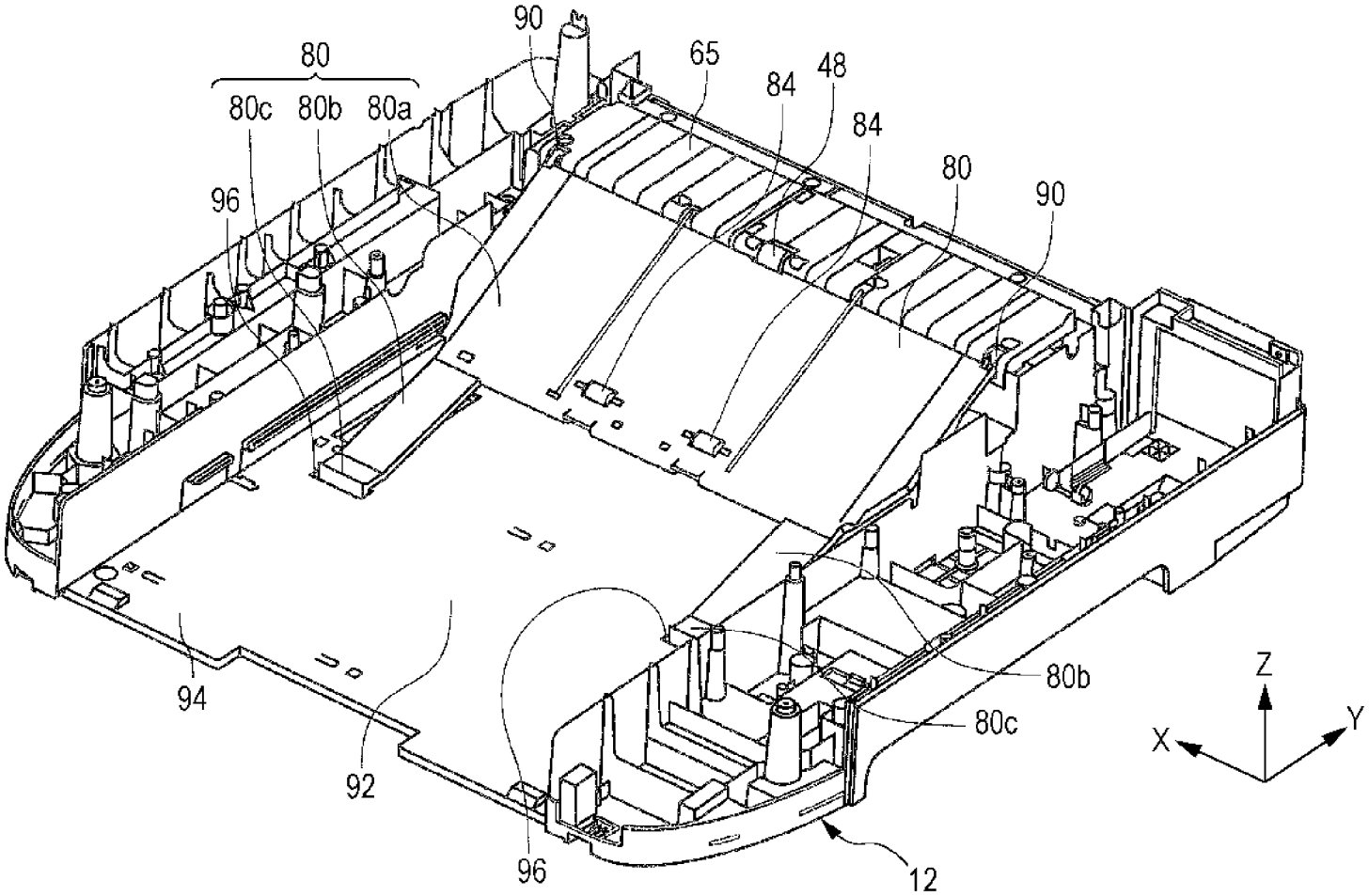
FIG. 5 is a perspective view which illustrates a second state of the path forming member of the printer according to the embodiment of the invention.
Figure 6:
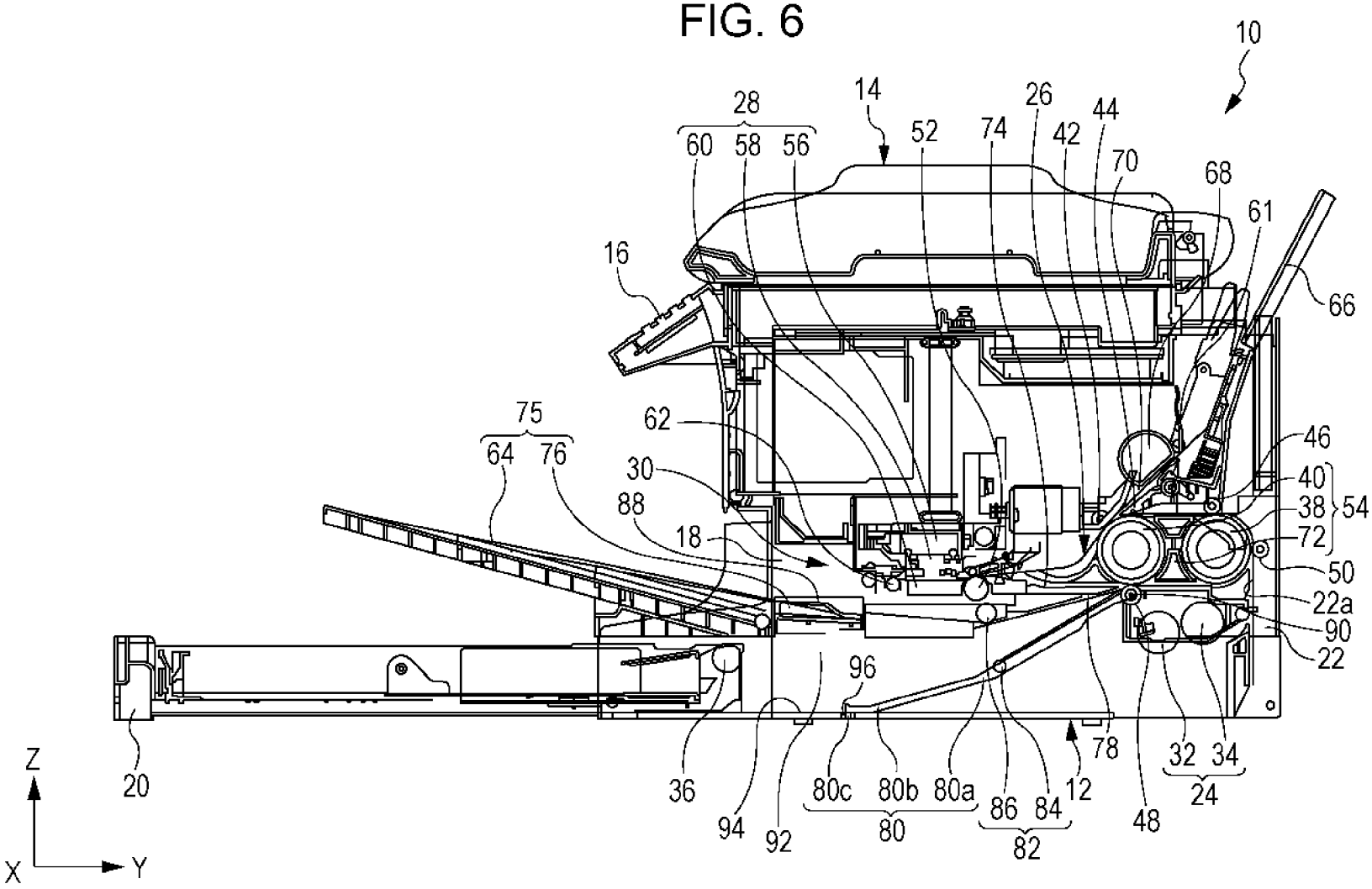
FIG. 6 is a sectional side view which illustrates a second state of the path forming member in the medium transport path of the printer according to the embodiment of the invention.

FIG. 4 is a perspective view which illustrates a first state of a path forming member of the printer according to the embodiment of the invention, FIG. 5 is a perspective view which illustrates a second state of the path forming member of the printer according to the embodiment of the invention, and FIG. 6 is a sectional side view which illustrates a second state of the path forming member in the medium transport path of the printer according to the embodiment of the invention.

In addition, in an XYZ coordinate system in each figure, the X direction denotes the scanning direction of a recording head, the Y direction denotes the depth direction of the recording apparatus, and the Z direction denotes the vertical direction of the printer. In addition, in each figure, the −Y direction side is set to the front side of the apparatus (direction in which medium is discharged), and the +Y direction side is set to an apparatus rear surface side (opposite side thereof).

When referring to FIG. 1, a printer 10 according to the embodiment of the invention is illustrated. The printer 10 includes an apparatus main body 12, and a document reading unit 14 which is rotatably provided with respect to the apparatus main body 12 on the upper part of the apparatus main body 12. The apparatus main body 12 includes an operation panel unit 16 for operating of the printer 10 by a user, an opening portion 18 which opens on the front side of the apparatus, and a medium accommodating unit 20 which is arranged at the lower part of the opening portion 18, in the front side of the apparatus (−Y direction side in FIG. 1) as a "medium discharging direction side" which configures the periphery of the apparatus main body.

In addition, the apparatus main body 12 includes a rear surface cover 22 which is configured so as to be opened or closed with respect to the apparatus main body 12 in the apparatus rear surface side (+Y direction side in FIG. 1) as the "opposite side thereof". In addition, in FIG. 2, the rear surface cover 22 is in a closed state with respect to the apparatus main body 12.

Subsequently, a transport path of a medium in the printer 10 will be described. The printer 10 includes the medium accommodating unit 20, a feeding unit 24, a transport unit 26, a recording unit 28, and a discharging unit 30 in the apparatus main body 12. The medium accommodating unit 20 is configured so as to be mounted on, and detached from the front side of the apparatus (−Y direction side in FIG. 3) with respect to the apparatus main body 12 (refer to FIG. 6).

In addition, the medium accommodating unit 20 is provided at the lower part of a recording head 58 of a recording unit 28 which will be described later in the Z axis direction, and is configured so as to handle a medium from the front side of the apparatus (−Y side in FIG. 3). In addition, the medium is plain paper, cardboard, glossy paper, or the like, which can be used in the printer 10.

The feeding unit 24 includes a pickup roller 32 and a feeding roller 34. The pickup roller 32 sends out a medium at the top to the feeding roller 34 from the medium accommodating unit 20 by rotating by being in contact with the medium at the top which is accommodated in the medium accommodating unit 20 when the medium accommodating unit 20 is mounted on the apparatus main body 12.

When the medium accommodating unit 20 is mounted on the apparatus main body 12, the feeding roller 34 transports a medium to the transport unit 26 which is located on the downstream side of the transport path by nipping the medium with a feeding driven roller 36 which is located at a position on the +Y direction side in the medium accommodating unit 20, that is, arranged on the tip end side of the medium accommodating unit 20.

In addition, the inner surface 22*a* of the rear surface cover 22, that is, the surface on the −Y direction side in FIG. 1 configures a part of the transport path of the medium to the transport unit 26 from the feeding unit 24 when the rear surface cover 22 is in a closed state with respect to the apparatus main body 12.

The transport unit 26 includes a first roller 38, a second roller 40, a first driven roller 42, a second driven roller 44, a third driven roller 46, a fourth driven roller 48, and a fifth driven roller 50 as "driven rollers", and a pair of first transport rollers 52. In addition, the first and second rollers 38 and 40 configure a reversing transport path 54.

In addition, the first and second rollers 38 and 40 are rotatably driven counterclockwise, respectively, by a driving mechanism (not shown). In addition, in the example, the first driven roller 42, the second driven roller 44, the third driven roller 46, the fourth driven roller 48, and the fifth driven roller 50 are provided on the apparatus main body 12 side.

The reversing transport path 54 is configured so as to be detached from the apparatus main body 12. Specifically, the reversing transport path can be detached from the apparatus main body 12 by being displaced to the +Y direction side in a state in which the rear surface cover 22 is open to the apparatus main body 12 (not shown). In addition, when the reversing transport path 54 is inserted into the apparatus main body 12 from the +Y direction side, and the rear surface cover 22 is closed with respect to the apparatus main body 12 in a state in which the reversing transport path 54 is detached from the apparatus main body 12, the reversing transport path 54 is attached to the apparatus main body 12.

In the transport unit 26, the medium is transported to the pair of first transport rollers 52 through the fifth driven roller 50 and the third driven roller 46 which come into contact with the first roller 38, and the second driven roller 44 and the first driven roller 42 which come into contact with the second roller 40 along the transport path. The recording unit 28 is provided on the downstream side in the transport path of the pair of first transport rollers 52 of the transport unit 26.

The recording unit 28 includes a carriage 56 which is movable in the scanning direction (X axis direction in FIG. 3), the recording head 58 which is provided under the carriage 56, and ejects ink to the medium, and a platen 60 which faces the recording head 58, and is provided so as to support the medium.

In addition, the transport path of the medium from the medium accommodating unit 20 to a position facing the recording head 58 through the inner surface 22*a* of the rear surface cover 22, the fifth driven roller 50 and the third driven roller 46 which come into contact with the first roller 38, the second driven roller 44 and the first driven roller 42 which come into contact with the second roller 40, and the pair of first transport rollers 52 is set as a first medium transport path 61 of the medium. That is, the first medium transport path 61 is configured as a transport path which extends from the medium accommodating unit 20 to a position facing the recording head 58 through at least a part of the reversing transport path 54.

In addition, a discharging unit 30 is provided on the downstream side in the transport path of the recording unit 28. A pair of discharging rollers 62, and a first medium support tray 64 in which the medium discharged from the discharging rollers 62 is placed, and which also functions as a discharging stacker are provided by protruding from the opening portion 18 to the front side of the apparatus (−Y direction) in the discharging unit 30. The medium which is sent to the recording unit 28 from the transport unit 26 along the transport path is subject to recording on the front surface thereof. After the recording, the medium is nipped by the discharging roller 62, and is discharged to the first medium support tray 64 which is provided on the front side of the apparatus, through the opening portion 18.

In addition, when recording is performed on both surfaces of the medium in the printer 10, recording is performed on the first surface of the medium using the recording unit 28, and then the medium is returned to the reversing transport path 54 by having the side which becomes a rear end of the medium when being subject to the recording on the front surface as a tip end, due to backward feeding of the pair of first transport rollers 52 and the discharging roller 62. At this time, the medium is sent toward the fourth driven roller 48 which is located on the −Z direction side of the second roller 40 in the Z axis direction.

In addition, the medium is nipped by the second roller 40 and the fourth driven roller 48, is sent to a position between the first roller 38 and a support plate 65 which is located under the first roller, and is transported to the recording unit 28 again through the fifth driven roller 50 and the third driven roller 46 which come into contact with the first roller 38, the second driven roller 44 and the first driven roller 42 which come into contact with the second roller 40, and the pair of first transport rollers 52. In addition, recording is performed on the rear surface of the medium in the recording unit 28. Thereafter, the medium is nipped by the discharging roller 62, and is discharged to a medium reception unit 75 which also functions as the first medium support unit which is provided on the front side of the apparatus, and will be described later, through the opening portion 18.

In addition, a second medium support tray 66 as a "second medium support unit" is provided in the apparatus main body 12 at a position which is overlapping on the +Z direction side in the Z axis direction and the Y axis direction of the reversing transport path 54. The medium which is supported by the second medium support tray 66 is sent to the downstream side of the transport path of a feeding roller by a feeding roller 68 which is provided so as to face the second medium support tray on the −Z direction side of the second medium support tray 66. A transport path on the second medium support tray side 70 is provided on the downstream side of the transport path of the feeding roller 68.

The transport path on the second medium support tray side 70 joins the transport path of the medium from the medium accommodating unit 20, that is, the first medium transport path 61 between the first driven roller 42 and the second driven roller 44 which come into contact with the second roller 40 in the reversing transport path 54. For this reason, the medium which is supported by the second medium support tray 66 joins the first medium transport path 61 through the transport path on the second medium support tray side 70 using the feeding roller 68, is sent to the recording unit 28, and is subject to recording.

In addition, since the transport path on the second medium support tray side 70 joins the first medium transport path 61 at a position of the second roller 40 in the reversing transport path 54, it is possible to suppress the cost increase of the apparatus by sharing the transport path in a configuration including a plurality of medium transport paths.

Subsequently, the reversing transport path 54 will be described. The reversing transport path 54 is located on the side opposite to the medium discharging direction side with respect to the recording head 58 of the recording unit 28, that is, on the +Y direction side in FIG. 1, and is provided at a position at which a region occupied in the vertical direction of the apparatus, that is, in the Z axis direction overlaps with a region occupied by the recording head 58 in the Z axis direction. In addition, at least a part of a region occupied by the reversing transport path 54 is located at the upper part of the medium accommodating unit 20.

Since the reversing transport path 54 which reverses a medium is located on the +Y direction side in FIG. 1 with respect to the recording head 58, and is provided at a position at which the region occupied in the Z axis direction overlaps with the region occupied by the recording head 58 in the Z axis direction, it is possible to reduce a dimension in the vertical direction of the apparatus main body 12, that is, in the Z axis direction. In addition, since at least a part of the region occupied by the reversing transport path 54 is located at the upper part of the medium accommodating unit 20, it is possible to further reduce the dimension of the apparatus main body 12 in the Y axis direction in FIG. 1, and to provide a further minimized apparatus.

In addition, the reversing transport path 54 which is detachable from the apparatus main body 12 includes a reversing transport path unit 72 to which the first roller 38 and the second roller 40 are rotatably attached. The first roller 38 and the second roller 40 are arranged with a gap therebetween in the Y axis direction in the reversing transport path unit 72, and are arranged at an overlapping position in the Z axis direction. In addition, the first roller 38 is located on the upstream side of the second roller 40 in the first medium transport path 61.

In addition, the first roller 38 is attached to the reversing transport path unit 72 so that the peripheral surface thereof protrudes from the upper face and the lower face in the Z axis direction, and a rear end of the reversing transport path unit 72 in the Y axis direction. In addition, the second roller 40 is attached to the reversing transport path unit 72 so that the peripheral surface thereof protrudes from the top face and the lower face of the reversing transport path unit 72 in the Z axis direction.

For this reason, the first roller 38 can reverse the medium which is sent out from the recording head 58 of the recording unit 28 using the outer peripheral surface thereof. In addition, the second roller 40 can apply a transport force to the medium when the outer peripheral surface thereof faces a transport path portion before reversing due to the first roller 38, that is, the transport path portion on the lower face side of the reversing transport path unit 72, and a transport path portion after reversing, that is, a transport path portion on the top face side of the reversing transport path unit 72.

In this manner, the reversing transport path 54 configures at least a part of the first medium transport path 61, and a reversing path 74 which reverses the medium which is returned to the reversing transport path 54 from the recording head 58 due to the first roller 38, and returns the medium to the recording head 58.

In addition, since the medium reception unit (first medium support unit) 75 which receives a discharged medium also functions as the first medium support unit 75 which supports the medium which is inserted from the medium discharging direction side, it is possible to reduce a cost of the apparatus. In addition, since feeding of the medium through the medium reception unit (first medium support unit) is performed from the medium discharging direction side (−Y direction side), the operability is good, and it is not necessary to provide a large space on the +Y direction side which is the side opposite to the medium discharging direction side (usually, rear surface side of apparatus), and accordingly, it is possible to make the installation space of the apparatus small.

In addition, since the reversing transport path 54 includes the first roller 38 which reverses the medium, and the second roller 40 which can apply the transport force to the medium when the outer peripheral surface faces both the transport path portion before reversing due to the first roller 38, that is, the reversing transport path 74 and the transport path portion after reversing, that is, the first medium transport path 61, it is possible to secure the length of the reversing path for reversing the medium using the second roller 40 while preventing a diameter of the first roller 38 from increasing, and to correspond to a medium of a large size while preventing a size of the apparatus from increasing.

In addition, since the second roller 40 applies the transport force to the medium by facing both the transport path portion before reversing due to the first roller 38, that is, the reversing transport path 74 and the transport path portion after reversing, that is, the first medium transport path 61, it is possible to reduce the number of rollers which are arranged thereon, and to reduce the cost increase when the second roller 40 contributes to both the transport path portion before reversing, that is, the reversing transport path 74 and the transport path portion after reversing, that is, the first medium transport path 61.

EXAMPLE

Subsequently, the first medium support unit 75 which also functions as the medium reception unit 75 and a second medium transport path 78 will be described with reference to FIGS. 1 to 6. The first medium support unit 75 includes the first medium support tray 64 and a paper guiding unit 76. In the apparatus main body 12, the paper guiding unit 76 is provided so as to be located between the recording head 58 of the recording unit 28 and the medium accommodating unit 20 as illustrated in FIG. 1. The paper guiding unit 76 is configured so as to be inserted from the first surface side to the second surface side in the opening portion 18, that is, from the −Y direction side to the +Y direction side in the Y axis direction in FIG. 1, and guide the medium which is supported by the first medium support tray 64 to the downstream side of the transport path.

Here, since the medium accommodating unit 20 can handle the medium from the −Y direction side in FIG. 1 which is the medium discharging direction side, and feeding of the medium through the paper guiding unit 76 is also performed from the −Y direction side which is the medium discharging direction side, the operability is very good, and it is not necessary to provide a large installation space on the +Y direction side which is the side opposite to the medium discharging direction side (usually, rear surface side of apparatus) in FIG. 1, and accordingly, it is possible to make the installation space of the apparatus small.

In addition, the apparatus main body 12 includes a path forming member 80 on the +Y direction side of the paper guiding unit 76 in the Y axis direction. The path forming member 80 is provided at the upper part of the mounting region of the medium accommodating unit 20 along with the paper guiding unit 76 in the apparatus main body 12. The first medium support tray 64, the paper guiding unit 76, and the path forming member 80 form the second medium transport path 78 in the first state (state illustrated in FIG. 1) which will be described later.

In addition, the second medium transport path 78 joins the second roller 40 in the transport path portion before reversing due to the first roller 38 in the transport unit 26, that is, in the reversing path 74, and joins the first medium transport path 61 on the upstream of a contact position with the fourth driven roller 48 which comes into contact with the second roller 40.

That is, since the second medium transport path 78 of the medium which is inserted through the first medium support unit (medium reception unit) 75 joins the medium transport path before reversing, or the medium transport path after reversing due to the first roller 38, it is possible to suppress the cost increase of the apparatus by sharing the transport path.

Since the second medium transport path 78 of the medium which passes through the first medium support unit 75 is joined at the position of the second roller 40 in the transport path portion before reversing due to the first roller 38, that is, the reversing path 74, it is possible to apply the transport force to the medium at many more positions, and to further reliably transport the medium.

In addition, a pair of second transport rollers 82 as "pair of transport rollers" which transports the medium to the upstream side in the medium transport direction of a position at which the second medium transport path 78 joins the first medium transport path 61 is provided in the second medium transport path 78. The pair of second transport rollers 82 includes a second transport driven roller 84 (refer to FIGS. 2 and 3) as "one roller" which is provided in the path forming member 80, and a second transport driving roller 86 as "the other roller" which is provided on the apparatus main body 12 side. In addition, the second transport driving roller 86 is rotatably driven counterclockwise due to a driving source which is not shown.

In addition, a plurality of the second transport driven rollers 84 are provided with a gap therebetween in the X axis direction in FIG. 2. In addition, the second transport driving roller 86 (not shown) is also provided at a position corresponding to the second transport driven rollers 84 in the X axis direction on the apparatus main body 12 side. For this reason, since the medium is nipped by the plurality of pair of second transport rollers 82 in the X axis direction in FIG. 2 when transporting the medium in the second medium transport path 78, it is possible to prevent meandering of the medium when being transported.

Accordingly, the medium which is supported by the first medium support unit 75 in the second medium transport path 78 is transported along the second medium transport path 78 by the pair of second transport rollers 82, and is sent out to the first medium transport path 61 which joins the second medium transport path 78.

In the second medium transport path 78 to which the medium which is inserted through the first medium support unit (medium reception unit) 75 is transported, the pair of second transport rollers 82 which nips and transports the medium is provided on the upstream side in the medium transport direction of the position at which the second medium transport path 78 joins the first medium transport path 61 on which the medium which is sent out from the medium accommodating unit 20 is transported. The upstream side in the medium transport direction of the position at which the second medium transport path joins the first medium transport path 61 is the −Y direction side in FIG. 1 which is the medium discharging direction side. Due to this, since the pair of second transport rollers 82 nips the medium at a position which is closer to the first medium support unit 75 on the −Y direction side, when the medium is supplied trough the first medium support unit 75, it is not necessary to insert the medium into a deep position of the apparatus main body 12, and it is possible to easily insert the medium.

When referring to FIGS. 2 and 3, the paper guiding unit 76 extends in the X axis direction, and includes a pair of medium edge guides 88. The pair of medium edge guides 88 is configured so as to move in a direction in which the guides become closer to each other, or are separated from each other in the X axis direction in FIG. 2.

The pair of medium edge guides 88 aligns the medium by being in contact with both side portions of the medium when the medium is set in the paper guiding unit 76, and prevents meandering of the medium when the medium is transported to the downstream side of the second medium transport path 78 by being nipped by the pair of second transport rollers 82.

In addition, the path forming member 80 will be described in detail with reference to FIGS. 4 to 6. The path forming member 80 is configured so as to rotate with respect to the apparatus main body 12. That is, the path forming member 80 is configured so as to switch between the first state in which the first medium support tray 64, the paper guiding unit 76, and the second medium transport path 78 are formed (refer to FIG. 1) and the second state in which the second medium transport path 78 is exposed to the medium discharging direction side, that is, the −Y direction side in FIG. 6 (refer to FIG. 6).

When referring to FIGS. 4 and 5, the path forming member 80 includes a path portion 80*a*, a pair of arm portions 80*b*, and a unit to be regulated 80*c*. The upper face side of the path portion 80*a* in the Z axis direction which is formed in a flat plate shape configures a part of the second medium transport path 78. The pair of arm portions 80*b* protrudes from both end portions in the X axis direction in FIGS. 4 and 5 to the −Y direction side in FIGS. 4 and 5 in the path portion 80*a*. The unit to be regulated 80*c* is provided at a tip end of each of the arm portions 80*b*, that is, an end portion on the −Y direction side.

In addition, a rotating axis 90 is provided at an end portion of the path portion 80*a* on the +Y direction side in FIGS. 4 and 5. The rotating axis 90 is attached to the support plate 65 on the apparatus main body 12 side, and rotates the path forming member 80 with respect to the support plate 65.

In addition, a pair of regulation units 96 (refer to FIG. 4) which has a concave shape is provided on a base 94 in a mounting region 92 of the medium accommodating unit 20 with a gap therebetween in the X axis direction, in the apparatus main body 12. The regulation unit 96 is provided at a position at which the regulation unit 96 engages with a unit to be regulated 80*c* of the path forming member 80 when the path forming member 80 rotates by having the rotating axis 90 as a fulcrum.

In addition, though it is not illustrated, a path forming member maintaining unit is provided on a lower face 76*a* of the paper guiding unit 76. The path forming member maintaining unit engages with the unit to be regulated 80*c*, and maintains the first state of the path forming member 80 when the path forming member 80 is in the first state. In addition, when the engaged state of the path forming member maintaining unit and the unit to be regulated 80*c* is released, the path forming member 80 rotates by having the rotating axis 90 as a fulcrum due to its own weight, and the unit to be regulated 80*c* and the regulation unit 96 are engaged, thereby entering the second state (refer to FIGS. 5 and 6), when a lever (not shown) which is provided on the lower face 76*a* of the paper guiding unit 76 is operated.

In addition, when the path forming member 80 is switched to the first state from the second state, the path forming member maintaining unit engages with the unit to be regulated 80*c*, and the first state of the path forming member 80 is maintained by the path forming member maintaining unit. In addition, the path forming member maintaining unit and the lever in the example have well-known configurations.

Accordingly, since the path forming member 80 which forms the second medium transport path 78 of the medium which is inserted through the medium reception unit 75 along with the medium reception unit 75 can expose the second medium transport path 78 to the medium discharging direction side (−Y direction side) by descending to a mounting region 92 from the upper part of the mounting region 92 of the medium accommodating unit 20, it is possible to remove a jammed medium from the medium discharging direction side (−Y direction) when the medium is jammed in the second medium transport path 78 of the medium which is inserted through the medium reception unit 75, that is, it is possible to easily remove the jammed medium.

In addition, when the path forming member 80 is switched to the second state (refer to FIG. 6) from the first state (refer to FIG. 1), the second transport driven roller 84 which configures the pair of second transport rollers 82, and is provided in the path forming member 80 is separated from the second transport driving roller 86.

In this manner, since the second transport driven roller 84 which configures the pair of second transport rollers 82 is separated from the second transport driving roller 86, it is possible to release a nipped state of the medium due to the pair of second transport rollers 82, and to further easily remove a jammed medium.

In addition, in the path forming member 80, a displacement of the path forming member 80 from the medium discharging direction side to the opposite side, that is, from the −Y direction side to the +Y direction side in FIGS. 5 and 6 is regulated when the unit to be regulated 80*c* and the regulation unit 96 are engaged during a time in the second state of the path forming member.

When the medium accommodating unit 20 is inserted into the mounting region 92 in a state in which the path forming member 80 descends to the mounting region 92, that is, the second state (refer to FIG. 6), there is a concern that the path forming member 80, and the mounting structure unit of the path forming member (support plate 65, rotating axis 90, or the like) may be damaged. However, since the unit to be regulated 80*c* is provided in the path forming member 80, the unit to be regulated 80*c* engages with the regulation unit 96 which is formed on the base 94 which configures the mounting region 92 of the medium accommodating unit 20 in the second state (refer to FIG. 6), and a displacement of the path forming member 80 from the medium discharging direction side (−Y direction side in FIG. 6) to the opposite side thereof (+Y direction side in FIG. 6) is regulated, it is possible to avoid the above described damage.

Modification Example of Example (1) In the example, the first driven roller 42, the second driven roller 44, the third driven roller 46, the fourth driven roller 48, and the fifth driven roller 50 are provided on the apparatus main body 12 side, however, the rollers may have a configuration in which the rollers are provided in the reversing transport path unit 72 along with the first roller 38 and the second roller 40, and are detachable from the apparatus main body 12 as the reversing transport path 54.

(2) In the example, the transport path on the second medium support tray side 70 joins the first medium transport path 61 between the first driven roller 42 and the second driven roller 44 which respectively come into contact with the second roller 40, however, the transport path may join the first medium transport path 61 at the position of the first roller 38. According to such a configuration, it is possible to suppress the cost increase of the apparatus by sharing the transport path in a configuration including a plurality of medium transport paths.

According to the above descriptions, the printer 10 in the embodiment includes the recording head 58 which performs recording on the medium, the first roller 38 which reverses the medium which is sent out from the recording head 58 side, the second roller 40 which can apply the transport force to the medium when the outer peripheral surface faces both the medium transport path portion before reversing due to the first roller 38 and the medium transport path portion after reversing, and the medium reception unit 75 which is provided on the downstream side of the recording head 58 in the medium transport path, and receives the discharged medium, and the medium reception unit 75 also functions as the first medium support unit 75 which supports the medium which is inserted from the medium discharging direction side.

The second medium transport path 78 of the medium which is inserted through the medium reception unit 75 joins the medium transport path before reversing, or the medium transport path after reversing due to the first roller 38. In addition, the transport path of the medium which is inserted through the medium reception unit 75 is joined at the position of the second roller 40 in the medium transport path before reversing due to the first roller 38.

The transport path on the second medium support tray side 70 of the medium which is inserted through the second medium support tray 66, which includes the second medium support tray 66 which supports the medium inserted into the apparatus main body 12 joins the second medium transport path 78 on which the medium which is inserted through the medium reception unit 75 is transported at the position of the first roller 38, or the second roller 40.

The medium accommodating unit 20 which is provided at a position lower than the recording head 58 in the vertical direction of the apparatus, and can handle the medium from the medium discharging direction side is included, and the medium which is sent out from the medium accommodating unit 20 reaches a position facing the recording head 58 through at least a part of the reversing transport path 54 which is formed by the first roller 38.

At least a part of the region occupied by the reversing transport path 54 is located at the upper part of the medium accommodating unit 20.

The second medium transport path 78 on which the medium which is inserted through the medium reception unit 75 is transported joins the first medium transport path 61 on which the medium which is sent out from the medium accommodating unit 20 is transported, and the pair of second transport rollers 82 which nips and transports the medium is provided on the upstream side in the medium transport direction of the position at which the second medium transport path joins the first medium transport path 61 on which the medium which is sent out from the medium accommodating unit 20 is transported, in the transport path on which the medium inserted through the medium reception unit is transported.

The medium accommodating unit 20 can be detached from the apparatus main body 12. In the apparatus main body 12, the path forming member 80 which forms the second medium transport path 78 of the medium which is inserted through the medium reception unit 75 is provided at the upper part of the mounting region 92 of the medium accommodating unit 20, along with the medium reception unit 75. The path forming member 80 is provided so as to switch between the first state in which the second medium transport path 78 of the medium which is inserted through the medium reception unit is formed along with the medium reception unit 75 and the second state in which the second medium transport path 78 of the medium which is inserted through the medium reception unit 75 is exposed to the −Y direction side due to descending of the path forming member from the upper part of the mounting region 92 to the mounting region 92 of the medium accommodating unit 20.

On the second medium transport path 78, the pair of second transport rollers 82 which nips and transports the medium is provided on the upstream side in the medium transport direction of the position at which the second medium transport path joins the first medium transport path 61. The second transport driven roller 84 which configures the pair of second transport rollers 82 is provided in the path forming member 80. When the path forming member 80 is switched from the first state to the second state, the second transport driven roller 84 which configures the pair of second transport rollers 82 is separated from the second transport driving roller 86.

The path forming member 80 includes the unit to be regulated 80*c* which can engage with the regulation unit 96 which is formed on the base 94 configuring the mounting region 92 of the medium accommodating unit 20. When the path forming member 80 is in the second state, the unit to be regulated 80*c* engages with the regulation unit 96, and accordingly, the displacement of the path forming member 80 from the −Y direction side to the +Y direction side is regulated.

In addition, according to the embodiment, the first medium support unit 75 and the path forming member 80 are applied to an ink jet printer as an example of a recording apparatus, however, it is also possible to apply the elements to a general liquid ejecting apparatus, in addition to that.

Here, the liquid ejecting apparatus is not limited to a recording apparatus such as a printer in which an ink jet recording head is used, and recording may be performed on a medium to be recorded upon by ejecting ink from the recording head, a copy machine, and a fax machine, and includes an apparatus in which liquid corresponding to the use, instead of ink, is ejected from a liquid ejecting head corresponding to the ink jet recording head to a medium to be ejected corresponding to a medium to be recorded upon, and the liquid is attached to the medium to be ejected.

As the liquid ejecting head, there is a coloring material ejecting head which is used when manufacturing a color filter of s a liquid crystal display, or the like, an electrode material (conductive pastes) ejecting head which is used when forming an electrode of an organic EL display, a surface emission display (FED), or the like, a biological organic substance ejecting head which is used when manufacturing a biochip, a sample ejecting head as a precision pipette, or the like, in addition to the recording head.

In addition, the invention is not limited to the above described examples, and various modifications can be made in the scope of the invention which is described in the scope of claims, and those are also included in the scope of the invention.

What is claimed is:

1. A recording apparatus comprising:

a medium accommodating unit which accommodates a medium;

a feeding unit which feeds the medium from the medium accommodating unit;

a recording unit which has a recording head which ejects ink to the medium;

a discharging unit which discharges the medium recorded by the recording unit;

a reversing transport path which reverses the medium fed from the medium accommodating unit toward the recording unit by the feeding unit;

a first medium transport path which extends from the reversing port path to the discharging unit through the recording unit;

a medium reception unit which receives the medium discharged by the discharging unit, and has an upstream end which is arranged at a place lower than the discharging unit;

a second medium transport path which leads from the upstream end of the medium reception unit to the reversing transport path, and is arranged between the first medium transport path and the medium accommodating unit; and a transporting unit which is arranged in the second medium transport path, and transports the medium set in the medium reception unit towards the reversing transport path.

2. The recording apparatus according to claim 1, further comprising a third medium transport path which transports the medium recorded by the recording unit towards the reversing transport path, wherein the medium is reversed by the reversing transport path and is transported towards the recording unit.

3. A recording apparatus comprising:

a medium support tray in which is set a medium;

a feeding unit which feeds the medium from the medium support tray;

a recording unit which has a recording head which ejects ink to the medium;

a discharging unit which discharges the medium recorded by the recording unit;

a first medium transport path which extends from the medium support tray to the discharging unit through the recording unit;

a medium reception unit which receives the medium discharged by the discharging unit, and has an upstream end which is arranged at a place lower than the discharging unit;

a reversing transport path which reverses the medium recorded by the recording unit and transported backward by a first transporting unit so as to transport towards the recording unit;

a second medium transport path which leads from the upstream end of the medium reception unit to the reversing transport path, and is arranged below the first medium transport path; and a second transporting unit which is arranged in the second medium transport path, and transports the medium set in the medium reception unit towards the reversing transport path.

4. The recording apparatus according to claim 3, further comprising a third medium transport path which transports the medium recorded by the recording unit towards the reversing transport path, wherein the medium is reversed by the reversing transport path and is transported towards the recording unit.

5. The recording apparatus according to claim 4, further comprising a third medium transport path which transports the medium recorded by the recording unit towards the reversing transport path, wherein the medium is reversed by the reversing transport path and is transported towards the recording unit.

6. A recording apparatus comprising:

a medium accommodating unit which accommodates a medium;

a feeding unit which feeds the medium from the medium accommodating unit;

a recording unit which has a recording head which ejects ink to the medium;

a discharging unit which discharges the medium recorded by the recording unit;

a reversing transport path which reverses the medium fed from the medium accommodating unit toward the recording unit by the feeding unit;

a first medium transport path which extends from the reversing transport path to the discharging unit through the recording unit;

a medium reception unit which receives the medium discharged by the discharging unit, and has an upstream end which is arranged at a place lower than the discharging unit; and a second medium transport path which leads from the upstream end of the medium reception unit to the reversing transport path, and is arranged between the first medium transport path and the medium accommodating unit.

7. A recording apparatus comprising:

a medium support tray in which is set a medium;

a feeding unit which feeds the medium from the medium support tray;

a recording unit which has a recording head which ejects ink to the medium;

a discharging unit which discharges the medium recorded by the recording unit;

a first medium transport path which extends from the medium support tray to the discharging unit through the recording unit;

a medium reception unit which receives the medium discharged by the discharging unit, and has an upstream end which is arranged at a place lower than the discharging unit;

a reversing transport path which reverses the medium recorded by the recording unit and transported backward by a transporting unit so as to transport towards the recording unit and;

a second medium transport path which leads from the upstream end of the medium reception unit to the reversing transport path, and is arranged below the first medium transport path.

8. The recording apparatus according to claim 7, further comprising a third medium transport path which transports the medium recorded by the recording unit towards the reversing transport path, wherein the medium is reversed by the reversing transport path and is transported towards the recording unit.

* * * * *